US005588384A

United States Patent [19]

Miyachi et al.

[11] Patent Number: 5,588,384

[45] Date of Patent: Dec. 31, 1996

[54] METHOD AND APPARATUS OF FOLDING OPPOSITE ENDS OF A PIECE OF TAPE

[75] Inventors: Nobuji Miyachi; Kouji Miyachi, both of Kyoto, Japan

[73] Assignee: HAMS Corporation, Kyoto, Japan

[21] Appl. No.: 518,397

[22] Filed: Aug. 15, 1995

[30] Foreign Application Priority Data

Aug. 19, 1994 [JP] Japan ..... 6-230142

[51] Int. Cl.[6] ..... D05B 35/06

[52] U.S. Cl. ..... 112/475.06; 112/470.34

[58] Field of Search ..... 112/475.06, 470.33, 112/475.13, 470.34, 147, 152, 104

[56] References Cited

U.S. PATENT DOCUMENTS

| | | | |
|---|---|---|---|
| 2,827,867 | 3/1958 | Happe | 112/122 |
| 3,792,672 | 2/1974 | Friedman et al. | 112/104 |
| 3,799,088 | 3/1974 | Marforio | 112/130 |
| 3,800,717 | 4/1974 | Olday | 112/20 |
| 4,114,544 | 9/1978 | Miyachi et al. | 112/104 |
| 4,127,075 | 11/1978 | Adamski, Jr. et al. | 112/122 |
| 4,137,857 | 2/1979 | Miyachi et al. | 112/470.34 |
| 4,561,366 | 12/1985 | Schmidt et al. | 112/104 X |
| 4,632,047 | 12/1986 | Seaman | 112/470.34 |
| 4,709,645 | 12/1987 | Jones et al. | 112/282 |

FOREIGN PATENT DOCUMENTS

| | | |
|---|---|---|
| 1231198 | 12/1966 | Germany . |
| 560273 | 3/1975 | Switzerland . |

*Primary Examiner*—Ismael Izaguirre

*Attorney, Agent, or Firm*—Greenblum & Bernstein, P.L.C.

[57] ABSTRACT

When a piece of tape is sewn as a belt loop on a garment such as, for example, pants, jeans or the like, opposite ends thereof is generally folded about 180°. Folding of the piece of tape is accomplished by a tape end folding apparatus, which includes two tape folding shafts extending parallel to each other in a direction generally perpendicular to a direction of travel of the piece of tape, a center pin extending from one end of each of the tape folding shafts in a direction longitudinally thereof, a side pin extending from the one end of each of the tape folding shafts in parallel to the center pin, and at least one biasing member disposed above and pressed against the center pin. Each of the opposite ends of the piece of tape is folded by the center and side pins by rotating the tape folding shafts in opposite directions with each of the opposite ends of the piece of tape sandwiched between the center pin and the biasing member.

7 Claims, 8 Drawing Sheets

METHOD AND APPARATUS OF FOLDING OPPOSITE ENDS OF A PIECE OF TAPE

BACKGROUND OF THE INVENTION

1. Field of the Invention

The present invention relates to a method of folding opposite ends of a piece of tape which is to be sewn as a belt loop on a garment such as, for example, pants, jeans or the like by a belt loop sewing machine. The present invention also relates to an apparatus, for effecting this method.

2. Description of Related Art

U.S. Pat. No. 4,114,544 discloses a method of folding opposite ends of a piece T1 of tape, as shown in FIG. 15. This method is applied to a belt loop sewing machine M having a sewing section 35 and a tape feeder F juxtaposed therewith. The tape feeder F comprises two tape folding shafts 25*a* and 25*b* extending generally parallel to each other and a tape slackening rod 24 disposed therebetween and having a diameter of about 10 mm. Each of the tape folding shafts 25*a* and 25*b* has a center pin and a side pin both extending from a distal end thereof in parallel to each other.

According to this method, each of opposite ends of the piece T1 of tape is first inserted between the center pin and the side pin with the tape slackening rod 24 disposed beneath the piece T1 of tape. The opposite ends of the piece T1 of tape are subsequently folded 180° downwardly by rotating the two tape folding shafts 25*a* and 25*b* in opposite directions. Then, the piece T1 of tape is supplied to and sewn on a waist part G of trousers placed on a sewing plate 36 of the sewing section 35, to thereby form a belt loop on the waist part G of the trousers.

As shown in FIG. 15, because the middle of the piece T1 of tape is lifted a predetermined height H by the tape slackening rod 24, the belt loop formed on the waist part G of the trousers is not tight but slack, thus facilitating insertion of a belt therein.

In this method, however, if the middle of the piece T1 of tape is lifted more than 11 mm, as shown by a double-dotted chain line in FIG. 15, there arises a problem that the opposite folded ends of the piece T1 of tape are occasionally removed from associated tape folding shafts 25*a* and 25*b* due to generation of gaps at folded portions K. Also, when the piece T1 of tape is supplied to the sewing plate 36 of the sewing section 35 so that the opposite folded ends of the piece T1 of tape may be positioned below associated holding members 37*a* and 37*b* with the middle of the piece T1 of tape lifted more than 11 mm, those portions P of the piece T1 of tape which are positioned above the folded ends impinge against the holding members 37*a* and 37*b* and, hence, the piece T1 of tape deviates from a desired position thereof, or at the worst, it is removed from the tape folding shafts 25*a* and 25*b*.

For this reason, the conventional method above cannot be used to form belt loops slackened by a height of more than 11 mm.

SUMMARY OF THE INVENTION

The present invention has been developed to overcome the above-described disadvantages.

It is accordingly an objective of the present invention to provide an improved method of folding opposite ends of a piece of tape and capable of forming a considerably slack belt loop.

Another objective of the present invention is to provide an apparatus for effecting the above-described method.

In accomplishing the above and other objectives, the method according to the present invention comprises the steps of:

(a) placing the piece of tape on a tape receiving member;

(b) pressing opposite ends of the piece of tape downwardly;

(c) holding the opposite ends of the piece of tape using two bifurcated tape folding shafts with at least one flat spring pressed against each of the bifurcated tape folding shafts; and (d) rotating the bifurcated tape folding shafts in opposite directions to fold the opposite ends of the piece of tape with each of the opposite ends sandwiched between the flat spring and associated one of the bifurcated tape folding shafts.

Conveniently, after the step (b), the middle of the piece of tape is lifted upwardly by a predetermined height in order to form a slack belt loop on a garment.

On the other hand, the apparatus according to the present invention comprises two tape folding shafts extending parallel to each other in a direction generally perpendicular to a direction of travel of the piece of tape, a center pin extending from one end of each of the tape folding shafts in a direction longitudinally thereof, a side pin extending from the one end of each of the tape folding shafts in parallel to the center pin, and a first biasing member disposed above and pressed against the center pin. By this construction, each of the opposite ends of the piece of tape is folded by the center and side pins by rotating the tape folding shafts in opposite directions with each of the opposite ends of the piece of tape sandwiched between the center pin and the first biasing member.

Advantageously, a second biasing member is provided so as to be outwardly spaced a predetermined distance from the first biasing member wherein when the opposite ends of the piece of tape are folded, each of the opposite ends is sandwiched between a side edge of the second biasing member and the center pin.

Conveniently, each of the tape folding shafts has a cam formed intermediately thereof for controlling the vertical position of the second biasing member.

Advantageously, an L-shaped tape slackening member is provided so as to be vertically movable between the tape folding shafts for slackening the piece of tape by lifting the middle of the piece of tape.

Preferably, the apparatus further comprises a pressure member vertically movably disposed between the tape slackening member and each of the tape folding shafts for pressing associated one of the opposite ends of the piece of tape.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
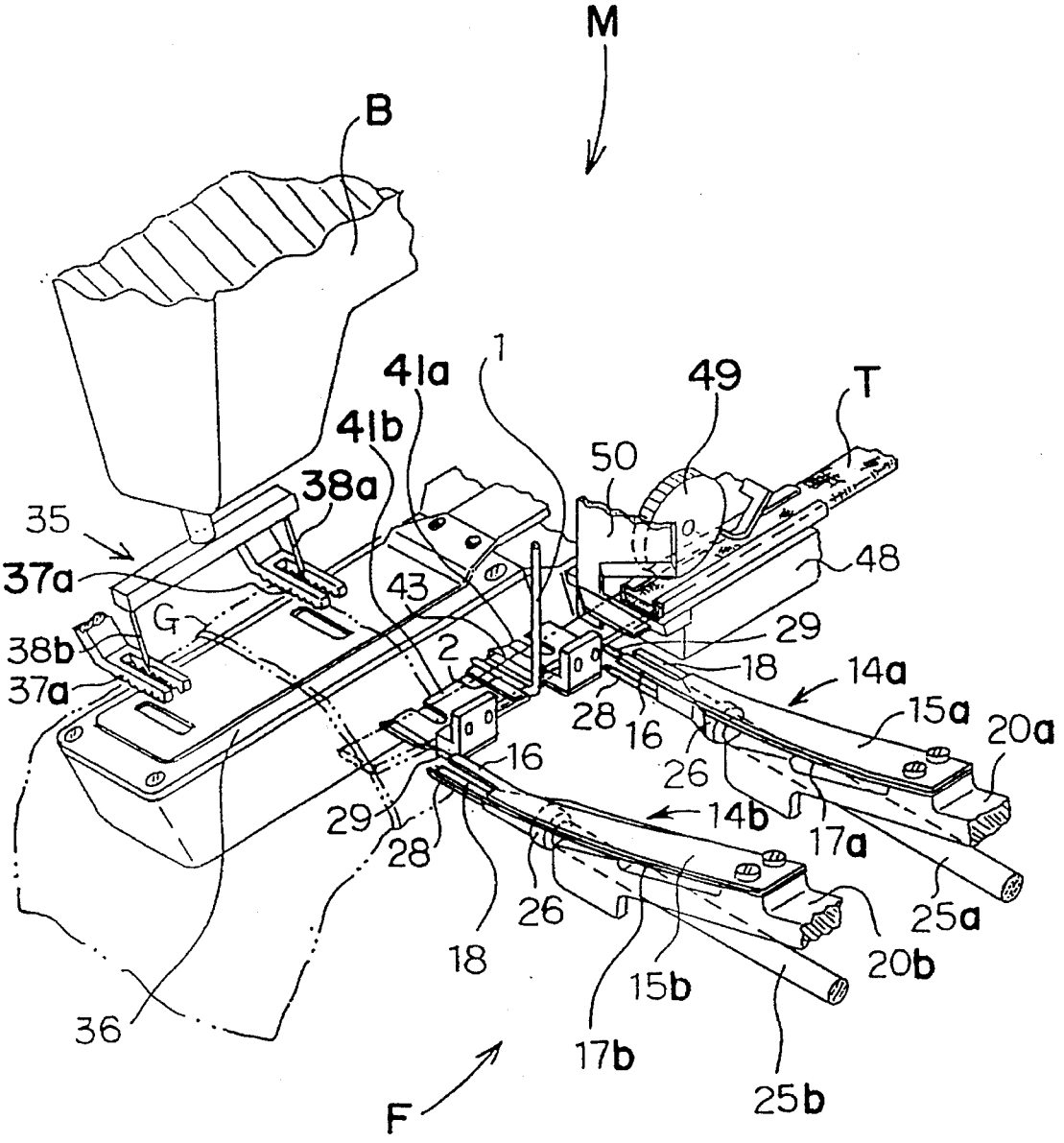
FIG. 1 is a fragmentary perspective view of a sewing machine provided with a tape end folding apparatus according to the present invention.

Referring now to the drawings, there is shown in FIG. 1 a sewing machine M dedicated for use in sewing belt loops on a garment such as, for example, pants, jeans or the like.

The sewing machine M comprises a machine body B having a sewing section 35, and a tape folding and feeding apparatus F juxtaposed with the machine body B for cutting a length of tape T into pieces T1 of a predetermined length and for feeding each piece T1 of tape towards the machine body B. The tape folding and feeding apparatus F is hereinafter referred to simply as a tape feeder.

The sewing section 35 includes a sewing plate 36 on which the garment is to be placed, two holding members 37*a* and 37*b* for holding opposite ends of the piece T1 of tape on the sewing plate 36, and two needles 38*a* and 38*b* for sewing a plurality of belt loops on the garment. The tape feeder F includes a tape feed platform 48 on which a length of tape T is placed, a tape feed roller 49 disposed above the tape feed platform 48 for feeding the tape T, a cutter 50 disposed downstream of the tape feed platform 48 with respect to a direction of travel of the tape T for cutting the tape T into pieces T1 of a predetermined length, and a pair of tape receiving plates 41*a* and 41*b* disposed downstream of the cutter 50 for successively receiving thereon the pieces T1 of tape cut by the cutter 50. The tape feeder F also includes two bifurcated tape folding shafts 25*a* and 25*b* extending parallel to each other in a direction generally perpendicular to the direction of travel of the tape T. Each of the tape folding shafts 25*a* and 25*b* has a center pin 28 and a side pin 29 both extending from a distal end thereof towards the machine body B in parallel to each other. The tape folding shafts 25*a* and 25*b* are linked with associated slide arms 20*a* and 20*b*, which are in turn connected with a drive mechanism (not shown). The tape folding shafts 25*a* and 25*b* are also connected to associated rotary air actuators 30*a* and 30*b* (only 30*b* shown in FIG. 5) movably carried by a feeder support (not shown) so as to be rotatable by approximately 270° to fold opposite ends of a piece T1 of tape.

When the opposite ends of the piece T1 of tape are first folded by associated tape folding shafts 25*a* and 25*b*, and the piece T1 of tape is subsequently fed onto a waist part G of trousers (indicated by a double-dotted chain line in FIG. 1) placed on the sewing plate 36, the holding members 37*a* and 37*b* are moved downwardly to press the folded ends of the piece T1 of tape against the sewing plate 36. Then, the two needles 38*a* and 38*b* are moved vertically reciprocally to simultaneously sew associated folded ends of the piece T1 of tape on the waist part G of the trousers.

Figure 2:
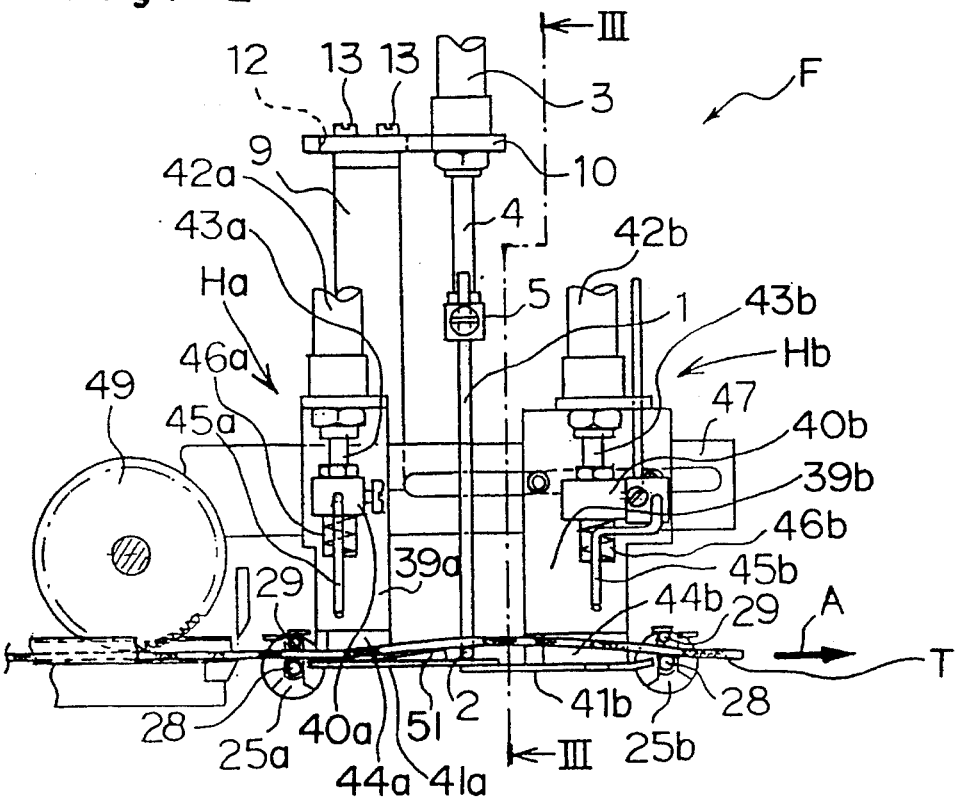
FIG. 2 is a side elevational view of the tape end folding apparatus shown in FIG. 1.
Figure 3:
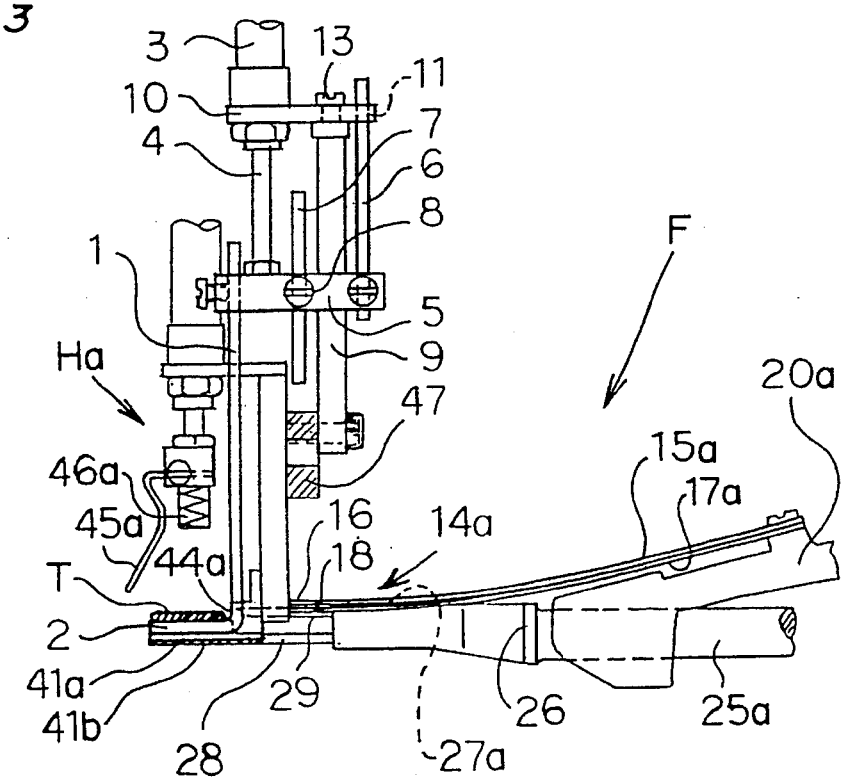
FIG. 3 is a sectional view taken along line III—III in FIG. 2.

As shown in FIGS. 2 and 3, the tape feeder F is provided with first and second tape aligning and holding mechanisms Ha and Hb both mounted on a horizontally extending holding rail 47 secured to the feeder support. The first tape aligning and holding mechanism Ha comprises a first air cylinder 42*a* secured to the holding rail 47 via a bracket 39*a* and having a vertically movable first rod 43*a*. A first movable block 40*a* is secured to a lower end of the first rod 43*a* and comprises a first guide rod 45*a* extending obliquely downwardly therefrom and a first compression coil spring 46*a* secured to a lower end thereof. Likewise, the second tape aligning and holding mechanism Hb comprises a second air cylinder 42*b* secured to the holding rail 47 via a bracket 39*b* and having a vertically movable second rod 43*b*. A second movable block 40*b* is secured to a lower end of the second rod 43*b* and comprises a second guide rod 45*b* extending obliquely downwardly therefrom and a second compression coil spring 46*b* secured to a lower end thereof.

A vertically extending arm 9 is secured to the holding rail 47, while a horizontally extending plate 10 is secured to an upper end of the vertically extending arm 9. A third air cylinder 3 having a vertically movable third rod 4 is secured to the horizontally extending plate 10 with a horizontally extending third movable block 5 secured to a lower end of the third rod 4. An L-shaped tape slackening rod 1 is connected at its upper end to the third movable block 5 so as to extend downwardly therefrom. Two tape receiving pieces 44*a* and 44*b* are fixedly mounted on lower ends of vertical walls of the brackets 39*a* and 39*b*, respectively.

When a length of tape T is fed onto the tape receiving plates 41*a* and 41*b* by the tape feed roller 49, it is moved laterally towards the tape receiving pieces 44*a* and 44*b* by the first and second guide rods 45*a* and 45*b* until a side edge of the tape T is brought into contact with outwardly facing surfaces of the tape receiving pieces 44*a* and 44*b*. The tape T is then pressed downwardly against the tape receiving plates 41*a* and 41*b* by the first and second compression coil springs 46*a* and 46*b*.

As shown in FIG. 3, the tape slackening rod 1 extending downwardly from the third movable block 5 has a free end forming a tape slackening portion 2 that is bent approximately 90° towards the machine body B so as to extend parallel to the upper surfaces of the tape receiving plates 41*a* and 41*b* in a direction generally perpendicular to the direction of travel of the tape T (shown by an arrow A in FIG. 2). A vertically extending guide pin 6 is connected at its lower end to the third movable block 5 with an upper end thereof loosely inserted in a guide hole 11 defined in the horizontally extending plate 10 so as to prevent rotation of the third movable block 5.

A vertically extending stopper rod 7 is secured to the third movable block 5 at an intermediate portion thereof by a setscrew 8. When the third air cylinder 3 is actuated to move the third movable block 5 upwardly, an upward movement of the third movable block 5 is limited by contact of an upper end of the stopper rod 7 with the lower surface of the horizontally extending plate 10. The distance of movement of the third movable block 5 can be readily adjusted by loosening the setscrew 8.

Although the horizontally extending plate 10 to which the third air cylinder 3 is secured is mounted on the upper surface of the vertically extending arm 9 by a plurality of screws 13, an opening 12 through which the screws 13 extend is elongated, as shown in FIG. 2, and, hence, the position of the horizontally extending plate 10 can be readily adjusted with respect to the direction of travel of the tape T by loosening the screws 13. Accordingly, when the overall length of belt loops is to be changed, the tape slackening portion 2 of the tape slackening rod 1 can be positioned at the middle of each piece T1 of tape cut by the cutter 50, i.e. at the middle between the two tape folding shafts 25*a* and 25*b*.

In FIG. 2, reference numeral 51 denotes a guide plate mounted on the upstream tape receiving plate 41*a* and having an inclined surface so as to prevent the leading end of the tape T from impinging against the tape slackening portion 2 of the tape slackening rod 1 when the tape T is fed onto the tape receiving plates 41*a* and 41*b*.

As shown in FIGS. 1 and 3, two symmetric tape clamps 14*a* and 14*b* for clamping opposite ends of the cut piece T1 of tape to fold them downwardly are secured at proximal ends thereof to upper surfaces of the slide arms 20*a* and 20*b* so as to be positioned above and aligned with the tape folding shahs 25*a* and 25*b*, respectively. The slide arms 20*a* and 20*b*, by which associated are folding shafts 25*a* and 25*b* are rotatably and vertically movably carried, are driven together with the tape folding shafts 25*a* and 25*b* by a drive mechanism (not shown) to move towards and away from the sewing section 35 of the machine body B. Each of the tape clamps 14*a* and 14*b* is made up of downwardly biased upper and lower flat springs 15*a* and 17*a* (or 15*b* and 17*b*) disposed one above the other and having respective shoulder portions from which regularly spaced respective prongs 16 and 18 having a width of about 3 mm extend towards the machine body B.

Figure 4:
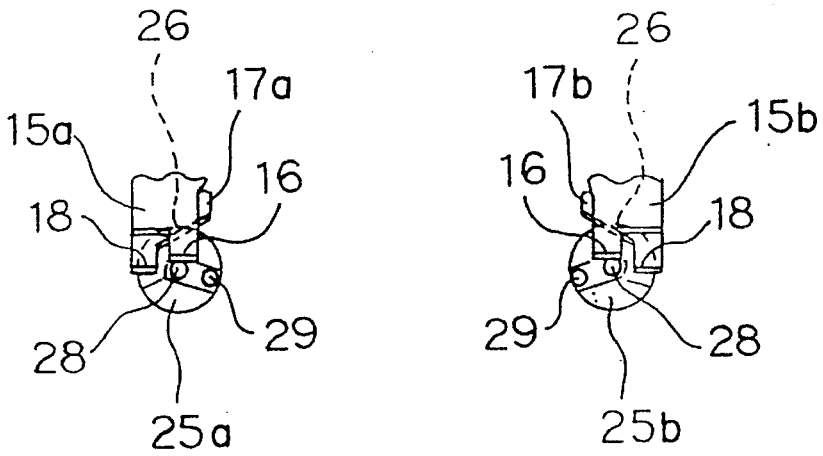
FIG. 4 is a side view of two mutually spaced bifurcated tape folding shafts, particularly indicating engagement thereof with associated flat springs.
Figure 5:
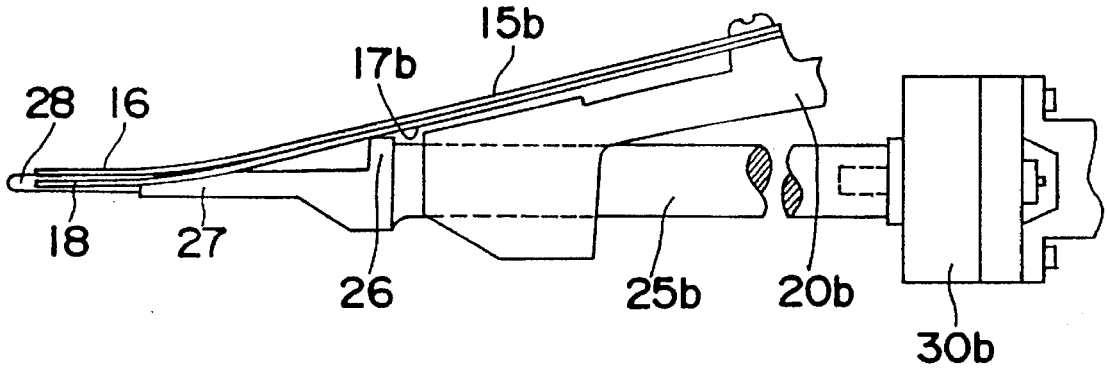
FIG. 5 is a front view of FIG. 4.

As shown in FIGS. 4 and 5, when the tape folding shafts 25*a* and 25*b* are rotated to fold opposite ends of the piece T1 of tape downwardly, the prongs 16 of the upper flat springs 15*a* and 15*b* are held in light contact with upper surfaces of the center pins 28 of the tape folding shafts 25*a* and 25*b*, respectively.

The prong 18 of the lower flat spring 17*a* is disposed upstream of the center pin 28 of the tape folding shaft 25*a* with respect to the direction of travel of the tape T in parallel thereto and is spaced therefrom by a distance corresponding to the thickness of the tape T (about 1.5 to 2.0 mm), while the prong 18 of the lower flat spring 17*b* is disposed downstream of the center pin 28 of the tape folding shaft 25*b* in parallel thereto and is spaced therefrom by a distance corresponding to the thickness of the tape T. The vertical positions of the prongs 16 and 18 relative to the associated center pins 28 are controlled by cams 26 formed intermediately of the tape folding shafts 25*a* and 25*b*. In particular, the prongs 18 of the lower flat springs 17*a* and 17*b* are controlled by associated cams 26 so as to position at the same level as the center pins 28.

Figure 7:
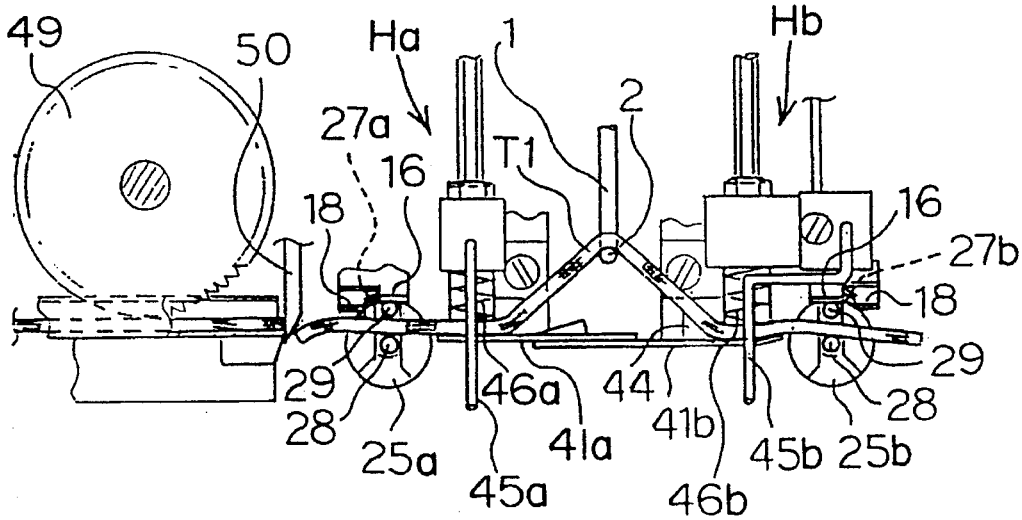
FIG. 7 is a view similar to FIG. 6, but indicating a state in which the middle of a piece of tape is lifted by a tape slackening rod.

As shown in FIGS. 3 and 7, when the opposite ends of the piece T1 of tape held on the tape receiving plates 41*a* and 41*b* are clamped by the tape clamps 14*a* and 14*b*, the shoulder portions of the upper and lower flat springs 15*a*, 15*b*, 17*a* and 17*b* are brought into contact with associated portions 27*a* and 27*b* of the tape folding shafts 25*a* and 25*b* so that the prongs 16 and 18 of the upper and lower flat springs 15*a*, 15*b*, 17*a* and 17*b* may be positioned approximately at the same level as the side pins 29.

Figure 13:
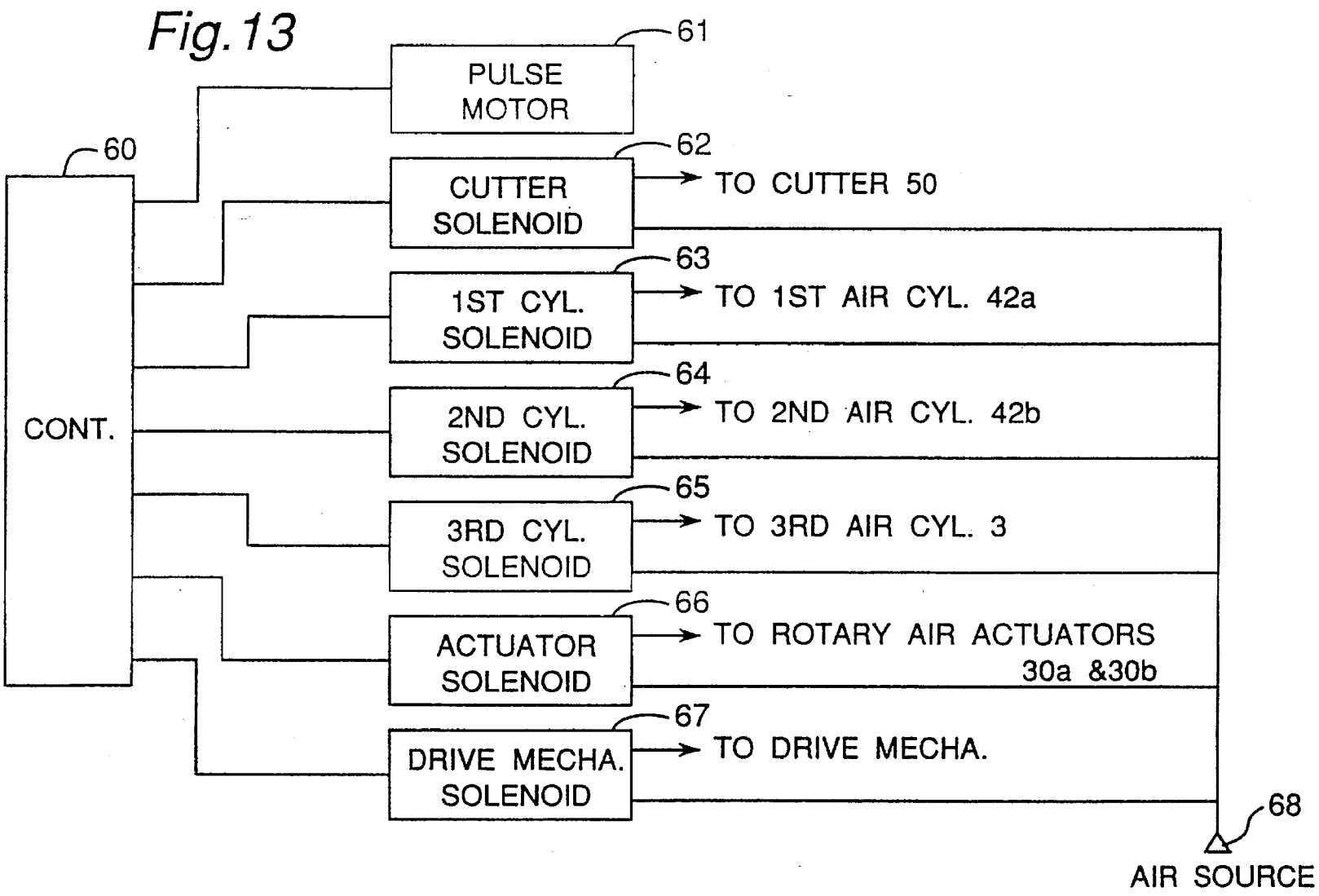
FIG. 13 is a block diagram of a control system for controlling the tape end folding apparatus shown in FIG. 1.

FIG. 13 depicts a control system C for controlling the tape feeder F referred to above.

The control system C comprises a controller 60 having a microcomputer, a pulse motor 61 drivingly connected to the tape feed roller 49 via a drive force transmission means such as, for example, a chain, a cutter operating solenoid 62 pneumatically connected to an air cylinder (not shown) for the cutter 50 for vertically moving a movable cutter element of the cutter 50 to cut a length of tape T into pieces T1 of a predetermined length, a first cylinder operating solenoid 63 pneumatically connected to the first air cylinder 42*a*, a second cylinder operating solenoid 64 pneumatically connected to the second air cylinder 42*b*, a third cylinder operating solenoid 65 pneumatically connected to the third air cylinder 3, an actuator operating solenoid 66 pneumatically connected to the two rotary air actuators 30*a* and 30*b*, and a drive mechanism operating solenoid 67 pneumatically connected to the drive mechanism. All of the pulse motor 61, the cutter operating solenoid 62, the first to third cylinder operating solenoids 63 to 65, the actuator operating solenoid 66, and the drive mechanism operating solenoid 67 are electrically connected to and controlled by the controller 60. Furthermore, all of the solenoids 62 to 67 are pneumatically connected to an air source 68.

The sewing machine M of the above-described construction operates as follows.

Figure 6:
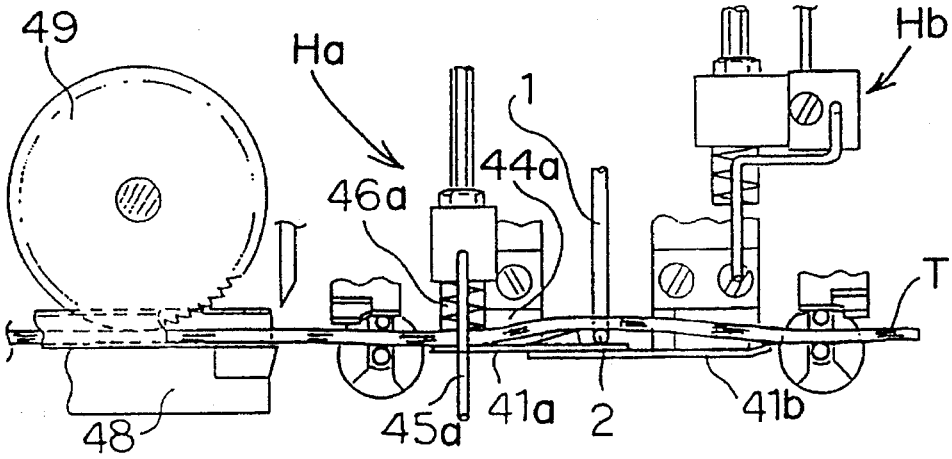
FIG. 6 is a side elevational view of the tape end folding apparatus when a length of tape is placed on tape receiving plates.

When a length of tape T placed on the tape feed platform 48 is moved towards the tape receiving plates 41*a* and 41*b* by a predetermined distance by the tape feed roller 49 and is placed on the tape receiving plates 41*a* and 41*b*, the first tape aligning and holding mechanism Ha operates, as shown in FIG. 6. More specifically, the first cylinder operating solenoid 63 actuates the first air cylinder 42*a* to move the first movable block 40*a* downwardly. As a result, the tape T is moved laterally by the first guide rod 45*a* so that the side edge thereof may be brought into contact with the outwardly facing surface of the tape receiving piece 44*a*. Then, the first compression coil spring 46*a* presses the tape T against the upstream tape receiving plate 41*a*.

Thereafter, the third cylinder operating solenoid 65 actuates the third air cylinder 3 to move the third movable block 5 upwardly so that the tape slackening rod 1 may be moved upwardly until the upper end of the stopper rod 7 impinges against the horizontally extending plate 10. At this moment, as shown in FIG. 7, the tape slackening portion 2 of the tape slackening rod 1 lifts that portion of the tape T which is located between the first and second coil springs 46*a* and 46*b*.

Concurrently with the actuation of the third air cylinder 3, the second cylinder operating solenoid 64 actuates the second air cylinder 42*b* to move the second movable block 40*b* downwardly. As a result, while the leading end of the tape T is moved downwardly by the second compression coil spring 46*b*, it is also moved laterally by the second guide rod 45*b* so that the side edge thereof may be brought into contact with the outwardly facing surface of the tape receiving piece 44*b*. Then, the second compression coil spring 46*b* presses the leading end of the tape T against the downstream tape receiving plate 41*b*.

Accordingly, the tape T are held by the first and second compression coil springs 46*a* and 46*b*, while the portion of the tape T located between the first and second compression coil springs 46*a* and 46*b* is liked by the tape slackening portion 2 of the tape slackening rod 1 so as to form a triangle.

Thereafter, the drive mechanism operating solenoid 67 actuates the drive mechanism to move the tape folding shafts 25*a* and 25*b* together with the slide arms 20*a* and 20*b* towards the tape receiving plates 41*a* and 41*b* with the side pins 29 positioned above the associated center pins 28 so that the tape T may be positioned between the center pin 28 and the side pin 29 of the tape folding shaft 25*a* and between the center pin 28 and the side pin 29 of the tape folding shaft 25*b*.

Figure 8:
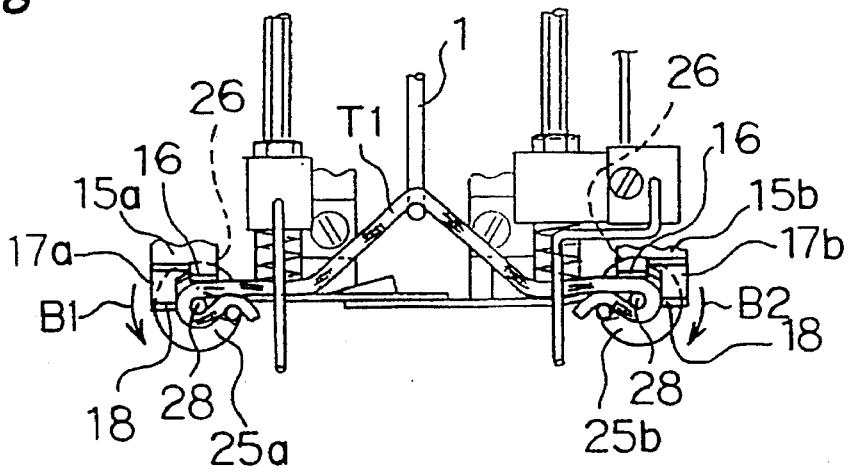
FIG. 8 is a side view of the piece of tape after opposite ends thereof has been folded downwardly by about 180°.

When the cutter operating solenoid 62 actuates the air cylinder for the cutter 50 to cut the tape T, the tape folding shafts 25*a* and 25*b* are simultaneously rotated about 270° in opposite directions shown by B1 and B2 in FIG. 8, respectively, thereby folding opposite ends of a cut piece T1 of tape downwardly by about 180°.

At this moment, the prong 16 of the upper flat spring 15*a* presses the trailing folded portion of the piece T1 of tape against the center pin 28 by a biasing force thereof, while the prong 16 of the upper flat spring 15*b* presses the leading folded portion of the piece T1 of tape against the center pin 28 by a biasing force thereof. At the same time, the prong 18 of the lower flat spring 17*a* is moved vertically relative to the prong 16 of the upper flat spring 15*a* by engagement of the lower surface of the lower flat spring 17*a* with the outer peripheral surface of the cam 26 formed on the tape folding shaft 25*a* and is eventually positioned at the same level as the center pin 28 of the tape folding shaft 25*a* so that the trailing folded portion of the piece T1 of tape may be sandwiched between the side edge of the prong 18 of the lower flat spring 17*a* and the center pin 28 of the tape folding shaft 25*a*. Likewise, the leading folded portion of the piece T1 of tape is sandwiched between the side edge of the prong 18 of the lower flat spring 17*b* and the center pin 28 of the tape folding shaft 25*b*.

Figure 14:
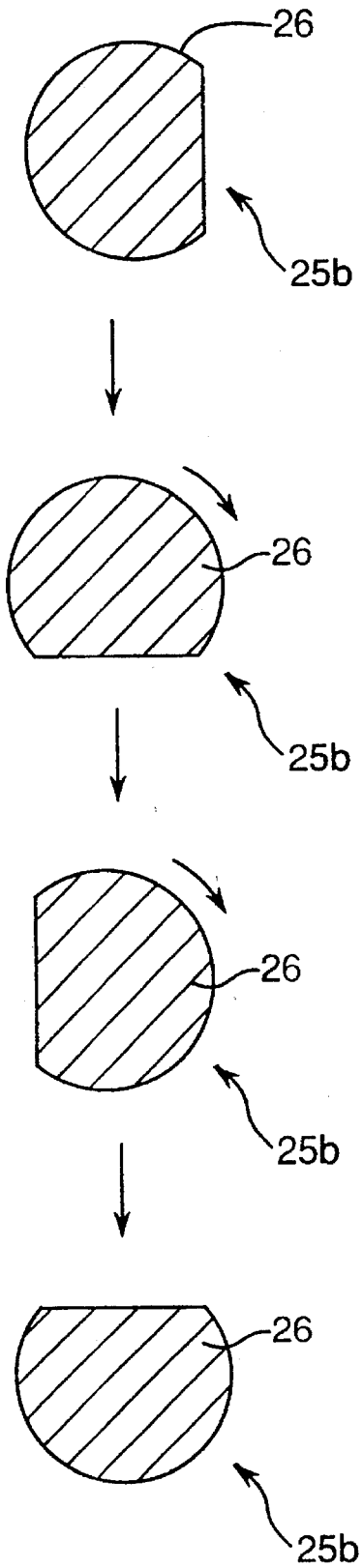
FIG. 14 is a sectional view of a cam formed on each of the tape folding shafts during rotation thereof.

FIG. 14 depicts the sectional shape of the cam 26 of the tape folding shaft 25*b* during rotation thereof as viewed from the machine body B. The cam 26 of the tape folding shaft 25*a* is rotated in a direction opposite to the direction of rotation shown in FIG. 14.

According to the sectional shape of the cams 26, the prongs 18 of the lower flat springs 17*a* and 17*b* are first positioned approximately at the same level as the prongs 16 of the upper flat springs 15*a* and 15*b*, and are gradually moved downwardly when the rotational angle of the tape folding shafts 25*a* and 25*b* become greater than about 180°. When the tape folding shafts 25*a* and 25*b* are rotated by about 270°, the prongs 18 of the lower flat springs 17*a* and 17*b* are positioned approximately at the same level as the center pins 28 so as to positively hold the opposite folded portions of the piece T1 of tape, respectively.

Figure 9:
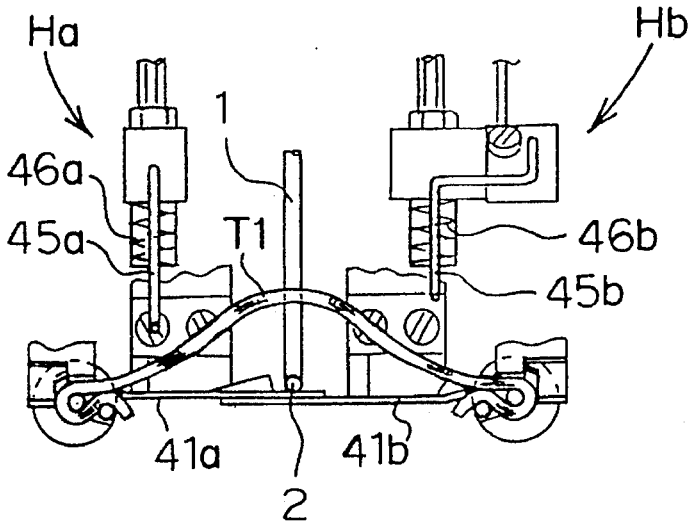
FIG. 9 is a view similar to FIG. 8, but indicating a state in which the opposite ends of the piece of tape are held by the tape folding shafts and the flat springs.

Thereafter, as shown in FIG. 9, the first and second cylinder operating solenoids 63 and 64 simultaneously actuate the first and second air cylinders 42*a* and 42*b* to move the first and second movable block 40*a* and 40*b* upwardly, respectively, while the third cylinder operating solenoid 65 actuates the third air cylinder 3 to move the third movable block 5 downwardly until the tape slackening portion 2 of the tape slackening rod 1 is brought into contact with the upper surface of the downstream tape receiving plate 41*a*.

In this way, the sewing machine M is held under a stand-by condition in readiness for supplying an upwardly bent piece T1 of tape to the sewing section 35.

Figure 10:
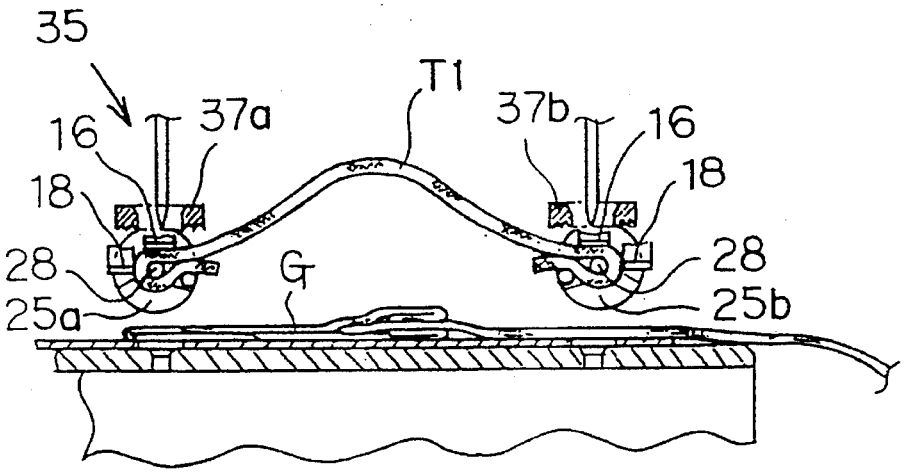
FIG. 10 is a side view of the piece of tape held by the tape folding shafts and the flat springs and fed to a sewing section of the sewing machine.

When a waist part G of trousers is placed on the sewing plate 36 of the machine body B and a start switch (not shown) is switched on, the drive mechanism moves the slide arms 20*a* and 20*b* towards the machine body B so that the upwardly bent slack piece T1 of tape, held by the tape folding shafts 25*a* and 25*b*, may be supplied immediately below the holding members 37*a* and 37*b* of the sewing section 35. At this moment, opposite folded end portions of the piece T1 of tape are securely held by the center pins 28 and the side pins 29 of the tape folding shafts 25*a* and 25*b* and the prongs 16 and 18 of the upper and lower flat springs 15*a*, 15*b*, 17*a* and 17*b*, while upper surfaces of the opposite folded end portions are maintained substantially flat in the horizontal direction by the action of the prongs 16 of the upper flat springs 15*a* and 15*b*, as shown in FIG. 10. Because of this, upper portions of the opposite folded end portions of the piece T1 of tape are positioned immediately below the associated holding members 37*a* and 37*b* so as to be spaced about 2 mm from lower surfaces thereof without impinging thereagainst.

Figure 11:
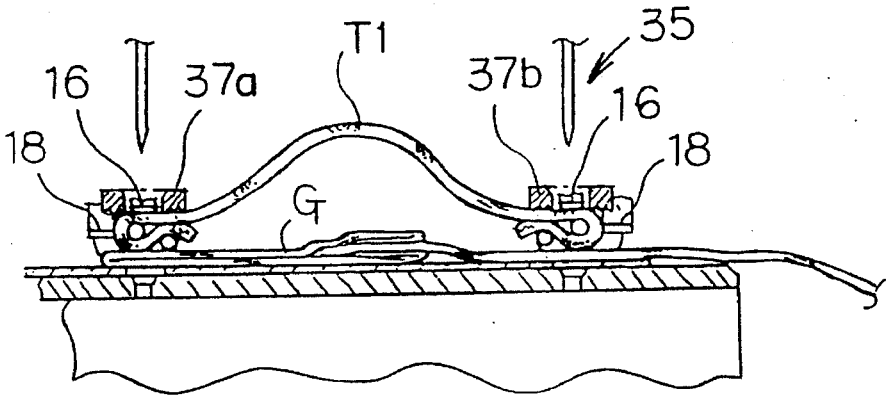
FIG. 11 is a view similar to FIG. 10, but indicating a state in which the opposite ends of the piece of tape are pressed downwardly by associated holding members.

Thereafter, as shown in FIG. 11, the holding members 37*a* and 37*b* are simultaneously moved downwardly to press the opposite folded end portions of the piece T1 of tape. At this moment, the prongs 16 of the upper flat springs 15*a* and 15*b* are positioned within needle slots defined in the holding members 37*a* and 37*b*, respectively, while the prongs 18 of the lower flat springs 17*a* and 17*b* are positioned below the holding members 37*a* and 37*b*, respectively.

Figure 12:
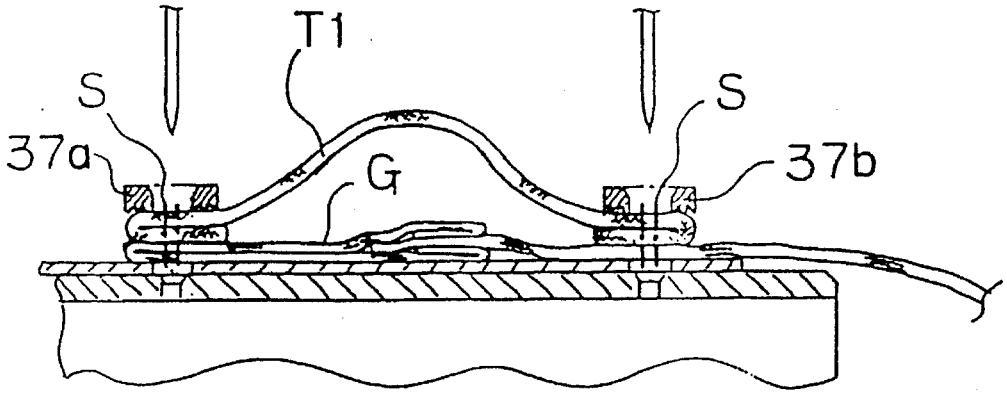
FIG. 12 is a view similar to FIG. 10, but indicating a state in which the opposite ends of the piece of tape have been sewn on a waist part of trousers to form a belt loop.
Figure 15:
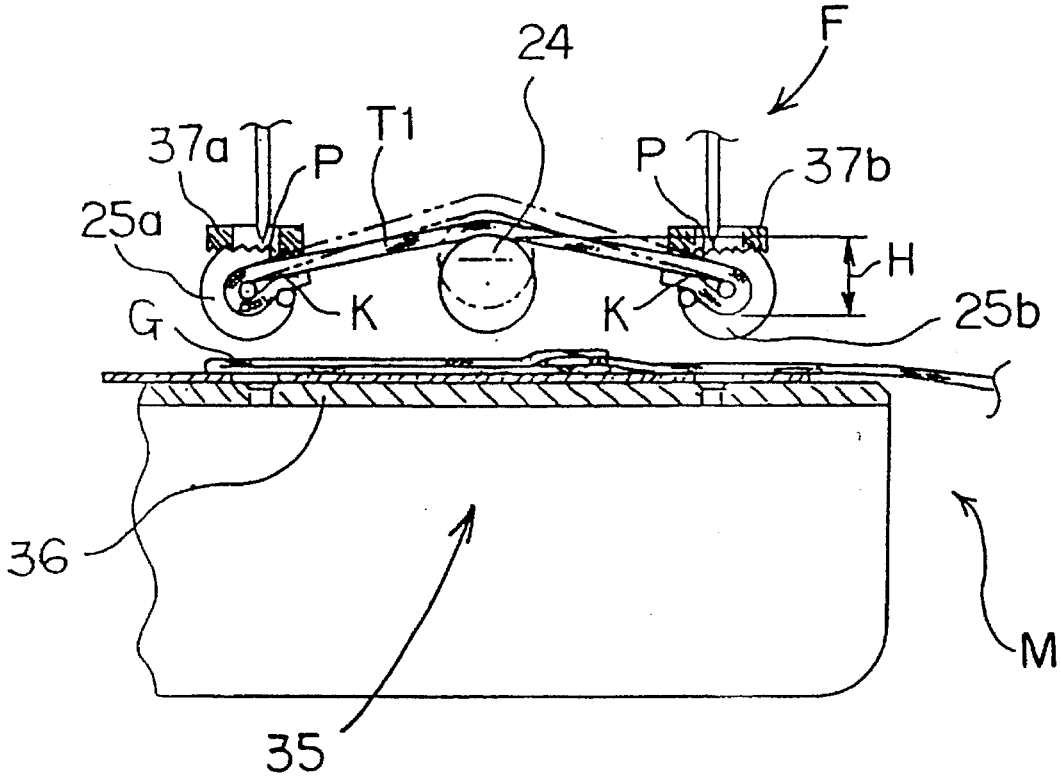
Fig. 15 PRIOR ART
FIG. 15 is a fragmentary side view of a conventional tape end folding apparatus.

Then, the drive mechanism moves the slide arms 20*a* and 20*b* away from the machine body B to thereby extract the center pins 28 and the side pins 29 from the opposite folded end portions of the piece T1 of tape, which are in turn sewn on the waist part G of the trousers, as shown in FIG. 12. Upon completion of the sewing operation, the holding members 37*a* and 37*b* are moved upwardly.

On the other hand, when the slide arms 20*a* and 20*b* reach their completely retracted positions, the tape folding shafts 25*a* and 25*b* are rotated in directions opposite to the directions shown by arrows B1 and B2 in FIG. 8, respectively. Then, the tape T is fed onto the tape receiving plates 41*a* and 41*b* by a predetermined length corresponding to the overall length of the belt loop, and the same operation as that referred to above is repeatedly carried out so that a required number of belt loops slackened by a height of more than 11 mm may be sewn on the waist part G of the trousers.

As described hereinabove, according to the present invention, after a piece T1 of tape placed on the tape receiving plates 41*a* and 41*b* has been slackened by a height of more than 11 mm by the tape slackening rod 1, opposite ends thereof are folded about 180° downwardly by the bifurcated tape folding shafts 25*a* and 25*b*. During folding, upper and side portions of the opposite ends of the piece T1 of tape are held by the prongs 16 of the downwardly biased upper flat springs 15*a* and 15*b* and by the prongs 18 of the downwardly biased lower flat springs 17*a* and 17*b*, respectively, thereby preventing disengagement of the opposite ends of the piece T1 of tape from the associated bifurcated tape folding shafts 25*a* and 25*b*.

Moreover, upon completion of the folding operation, the upper surfaces of the opposite folded end portions of the piece T1 of tape are pressed downwardly and maintained substantially flat in the horizontal direction by the prongs 16 of the upper flat springs 15*a* and 15*b*. Accordingly, when the piece T1 of tape is moved towards the machine body B, any undesired movement thereof on the tape folding shafts 25*a* and 25*b*, which has hitherto been caused by impingement of the opposite folded end portions against the holding members 37*a* and 37*b*, is avoided.

It is to be noted here that although in the above-described embodiment each of the tape clamps has been described as having upper and lower flat springs, one of them may be dispensed with under specific circumstances.

It is also to be noted that although in the above-described embodiment the tape feeder F has been described as having a tape slackening rod, it may be dispensed with if only tight belt loops are to be sewn on garments.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A method of folding opposite ends of a piece of tape which is to be sewn as a belt loop on a garment, said method comprising the steps of:

(a) placing the piece of tape on a tape receiving member;

(b) pressing opposite ends of the piece of tape downwardly;

(c) holding the opposite ends of the piece of tape using two bifurcated tape folding shafts with at least one flat spring pressed against each of the bifurcated tape folding shafts; and (d) rotating the bifurcated tape folding shafts in opposite directions to fold the opposite ends of the piece of tape with each of the opposite ends sandwiched between the flat spring and associated one of the bifurcated tape folding shafts.

2. The method according to claim 1, further comprising, after the step (b), the step of lifting the middle of the piece of tape upwardly by a predetermined height.

3. An apparatus for folding opposite ends of a piece of tape which is to be sewn as a belt loop on a garment, said apparatus comprising:

two tape folding shafts extending parallel to each other in a direction generally perpendicular to a direction of travel of the piece of tape;

a center pin extending from one end of each of said tape folding shafts in a direction longitudinally thereof;

a side pin extending from said one end of each of said tape folding shafts in parallel to said center pin; and a first biasing member disposed above and pressed against said center pin, whereby each of the opposite ends of the piece of tape is folded by said center and side pins by rotating said tape folding shafts in opposite directions with each of the opposite ends of the piece of tape sandwiched between said center pin and said first biasing member.

4. The apparatus according to claim 3, further comprising a second biasing member outwardly spaced a predetermined distance from said first biasing member wherein when the opposite ends of the piece of tape are folded, each of the opposite ends is sandwiched between a side edge of said second biasing member and said center pin.

5. The apparatus according to claim 4, wherein each of said tape folding shafts has a cam formed intermediately thereof for controlling a vertical position of said second biasing member.

6. The apparatus according to claim 3, further comprising an L-shaped tape slackening member vertically movably disposed between said tape folding shafts for slackening the piece of tape by lifting a middle of the piece of tape.

7. The apparatus according to claim 6, further comprising a pressure member vertically movably disposed between said tape slackening member and each of said tape folding shafts for pressing associated one of the opposite ends of the piece of tape.

* * * * *